US007587313B2

(12) United States Patent
Gerrits et al.

(10) Patent No.: US 7,587,313 B2
(45) Date of Patent: Sep. 8, 2009

(54) AUDIO CODING

(75) Inventors: Andreas Johannes Gerrits, Eindhoven (NL); Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 192 days.

(21) Appl. No.: 10/598,796

(22) PCT Filed: Mar. 8, 2005

(86) PCT No.: PCT/IB2005/050847

§ 371 (c)(1),
(2), (4) Date: Sep. 12, 2006

(87) PCT Pub. No.: WO2005/091275

PCT Pub. Date: Sep. 29, 2005

(65) Prior Publication Data

US 2007/0185707 A1 Aug. 9, 2007

(30) Foreign Application Priority Data

Mar. 17, 2004 (EP) ..... 04101100

(51) Int. Cl.
*G10L 19/14* (2006.01)

(52) U.S. Cl. ..... 704/211; 704/220; 704/205; 704/224; 704/219

(58) Field of Classification Search ..... 704/211, 704/219, 220, 207, 205, 224, 225
See application file for complete search history.

(56) References Cited

U.S. PATENT DOCUMENTS 5,327,518 A * 7/1994 George et al. ..... 704/211
5,504,833 A * 4/1996 George et al. ..... 704/211
6,978,236 B1 * 12/2005 Liljeryd et al. ..... 704/219
7,181,389 B2 * 2/2007 Liljeryd et al. ..... 704/219
7,191,121 B2 * 3/2007 Liljeryd et al. ..... 704/219
2006/0112811 A1 * 6/2006 Padhi et al. ..... 84/616
2007/0185707 A1 * 8/2007 Gerrits et al. ..... 704/201

FOREIGN PATENT DOCUMENTS

WO WO0169593 A1 9/2001

OTHER PUBLICATIONS

Taori, R. et al., ("Closed-loop tracking of sinusoids for speech and audio coding", 1999 IEEE Workshop on Speech Coding Proceedings, Jun. 20-23, 1999, pp. 1-3).*
Den Brinker et al: "Parametric Coding for High-Quality Audio"; Preprints of Papers Presented at the AES (Audio Engineering Society) Convention, May 10-13, 2002; pp. 1-10, XP009028433.

* cited by examiner

*Primary Examiner*—Vijay B Chawan

(57) ABSTRACT

The method creates an audio stream comprising tracks of sinusoidal components linked across a plurality of sequential time segments. Segments in each track are weighted with a normal window (WI, W2, W3), and consecutive segments have a normal period of overlap (0) of their trailing edges and leading edges. Segments in which a transient5 component is determined are weighted with a first modified window (WIm) having a modified trailing edge, and the following segment in the track is weighted with a second modified window (W2m) having a modified leading edge, so that the modified trailing edge and the modified leading edge have a modified period of overlap (0m) that comprises the transient component and that is shorter than the normal period of overlap (0), and wherein the audio stream includes sinusoidal codes representing the frequency and the transient. According to the invention, the modified period of overlap (0m) depends on the frequency value (f).

15 Claims, 2 Drawing Sheets

AUDIO CODING

Figure 1:
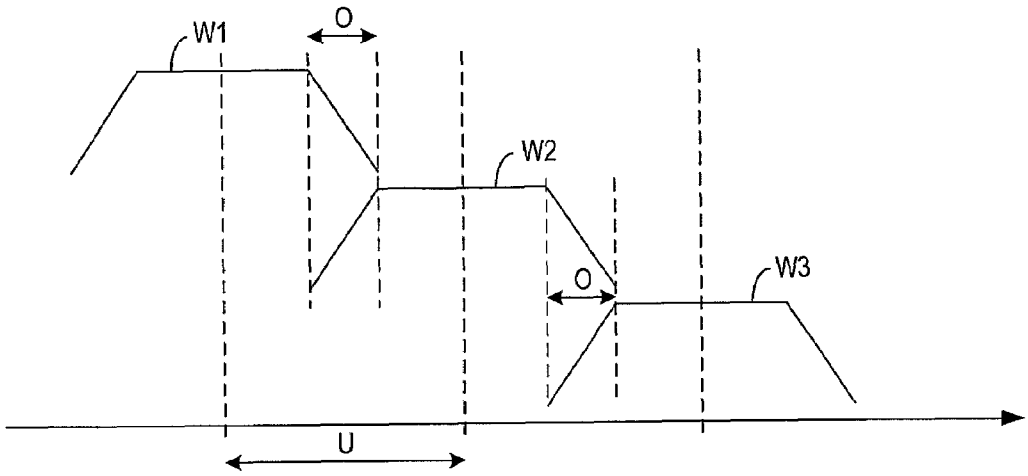

The present invention relates to encoding and decoding of broadband signals, in particular audio signals.

When transmitting broadband signals, e.g. audio signals such as speech, compression or encoding techniques are used to reduce the bandwidth or bit rate of the signal.

International Patent Application No. WO 01/69593, corresponding to U.S. Pat. No. 6,925,434, discloses a parametric encoding scheme, in particular a sinusoidal encoder, in which an input audio signal is split into several (possibly overlapping) time segments or frames, typically of duration 20 ms each. Each segment is decomposed into transient, sinusoidal and random components. It is also possible to derive other components of the input audio signal such as harmonic complexes, although these are not relevant for the purposes of the present invention.

In the encoder a sequential analysis is done. First, the transients are detected and synthesized. The synthesized transients are subtracted from the audio signal. On the residual signal, sinusoidal analysis is performed and the synthesized signal is subtracted from the residual signal, generating a second residual. This second residual can then be used as an input signal to other modules in the encoder, such as the noise module. In order to generate the second residual, a modified windowing at transient positions is used in the sinusoidal synthesis.

Once the sinusoidal information for a segment is estimated, a tracking algorithm is initiated. This algorithm uses a cost function to link sinusoids in different segments with each other on a segment-to-segment basis to obtain so-called tracks. The tracking algorithm thus results in sinusoidal codes comprising sinusoidal tracks that start at a specific time, evolve for a certain duration of time over a plurality of time segments and then stop.

In such sinusoidal encoding, it is usual to transmit frequency information for the tracks formed in the encoder. This can be done in a simple manner and with relatively low costs, since tracks only have slowly varying frequency. Frequency information can therefore be transmitted efficiently by time differential encoding. In general, amplitude can also be encoded differentially over time.

In a sinusoidal audio encoder, the audio signal is analysed and several components, in particular sinusoids, are identified and isolated. The sinusoids are synthesized by an overlap-add procedure. Typically, subsequent frames have a period of overlap of 50%. If a transient is present in a frame, the period of overlap is reduced in order to avoid pre-echoes. This is referred to as modified windowing. Traditionally, this (small) overlap is equal for all sinusoids. For low frequencies, this can result in audible artefacts.

In the SSC (Sinusoidal audio and Speech Coder) sinusoidal audio encoder [1], an input signal is decomposed into several parametric components. One of the components is the transient component. A part of the audio signal is labelled as a transient, if an event occurs that is very localized in time. Music examples are attacks of castanets or high-hats.

The transient model is described in detail in [1]. A summary will be given here. In the SSC encoder two types of transient are identified: a step transient and a Meixner transient—see [1] p 3. The transient estimation procedure consists of the following three steps:

1. Estimation of transient position in time where the position of the transient in the audio signal is determined. Also the type of the transient (step or Meixner) is determined.
2. Estimation of transient envelope: In case of a Meixner transient, the Meixner window is estimated, describing the time envelope of the transient.
3. Estimation of sinusoidal content where a number of sinusoids are estimated, using the estimated Meixner window, to describe the transient. The sinusoids are represented by a frequency, phase and amplitude.

Step transients are characterized by a sudden change in signal power level, i.e. there is a fast attack but virtually no decay. A characteristic feature of a step transient is its position, i.e. the time of its occurrence, and as such the position in time does not describe a signal by itself, but it is used to control the way, in which the elements of the sinusoidal object are synthesised. Based on the position parameter the same or a similar procedure is applied both to step transients and to Meixner transients.

Another type of components is the sinusoids. In sinusoidal modeling, the models are typically of the form:

$$s_n(t) = \sum_{k=1}^{K} u_k(t) \tag{1}$$

where $u_k$ is the underlying sinusoidal or sinusoidal-like signals and n is the segment number. For example, $u_k(t)$ can be defined by:

$$u_k(t)=A(t)\cdot\cos(\omega(t)\cdot t+\phi(t)) \tag{2}$$

where A(t), ω(t) and ϕ(t) are the amplitude, frequency and phase of the sinusoid. In order to reduce bit rate, these parameters are preferably kept constant within a segment, but as indicated they can be time variant.

Consecutive segments $s_n$ overlap each other. Therefore, the segments are multiplied by a window function (e.g. a Hanning window). The windows are designed to be amplitude complementary, i.e. the sum of consecutive windows is 1 at all times, in particular in overlapping periods. This is illustrated in FIG. 1. U denotes the update period of the sinusoidal parameters, and O denotes the period of overlap between the consecutive windows W1 and W2 and between the consecutive windows W2 and W3. A typical value of U is around 8 ms (or 360 samples with a sampling frequency of 44.1 kHz).

Figure 2:
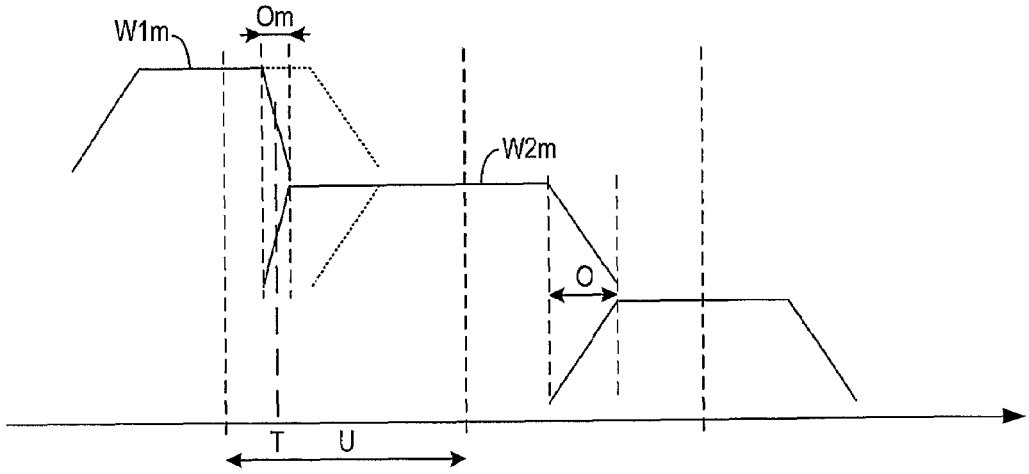

In FIG. 2 a transient is present in the segment, and the windowing is changed in order to reduce the effect of pre-echo. The transient position in indicated by T. The two windows W1m and W2m have been modified in comparison to FIG. 1. The dotted parts of the windows correspond to the unmodified windows W1 and W2 in FIG. 1. The window W1m comprising the transient position T is modified by "closing" the window at the transient position with a steeper trailing edge than for the unmodified windows in FIG. 1, and the duration of the modified window is correspondingly shortened. The following window is correspondingly modified by "opening" the window at the transient position with a steeper leading edge than for the unmodified windows in FIG. 1, and the duration of the modified window is correspondingly extended. Due to the steeper closing and opening edges of the windows the modified period of overlap Om between the consecutive modified windows W1m and W2m is correspondingly shortened.

In practice, this is done by reducing the period of overlap (e.g. to 10 samples) at the position of the transient. The non-overlapping parts of both windows are set to 1, i.e. the maximum value. This windowing for the sinusoidal synthesis is used in case of a step transient as well as Meixner transients, and both in the encoder and the decoder.

Figure 3:
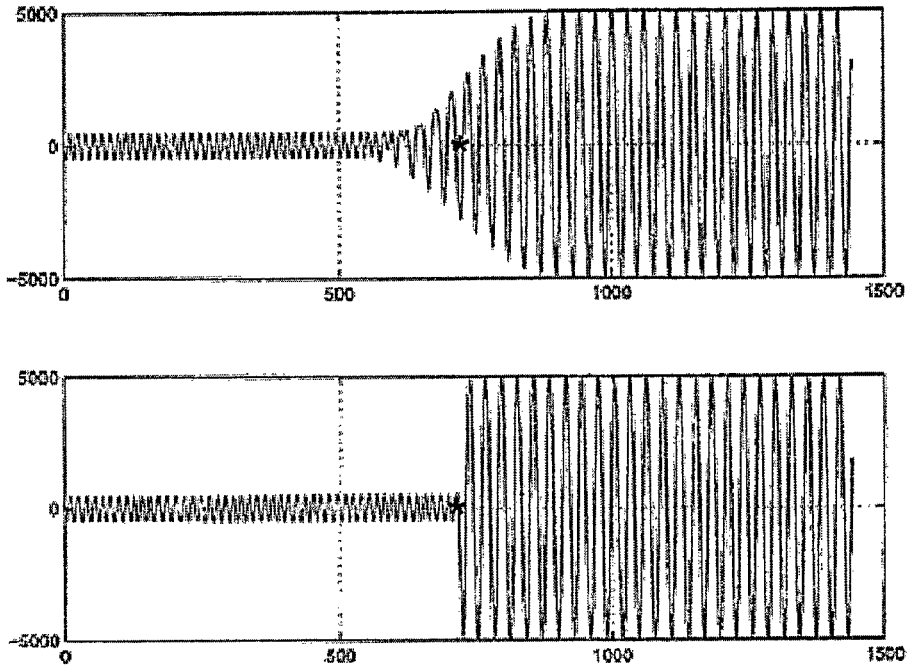

FIG. 3 illustrates this, where the signal contains a transient in the form of a step-like increase in its amplitude. The dashed vertical line marks the position of the transient. The top trace shows the waveform of synthesized sinusoids with an overlap of 360 samples, and the bottom trace shows the waveform of synthesized sinusoids with a reduced overlap of 10 samples. The top trace clearly has a pre-echo, whereby the temporal structure is lost, whereas in the bottom trace, the temporal structure is still intact due to the use of the modified windowing. This known modified windowing at transient positions provides a solution to avoid pre-echoes at transients.

Figure 4:
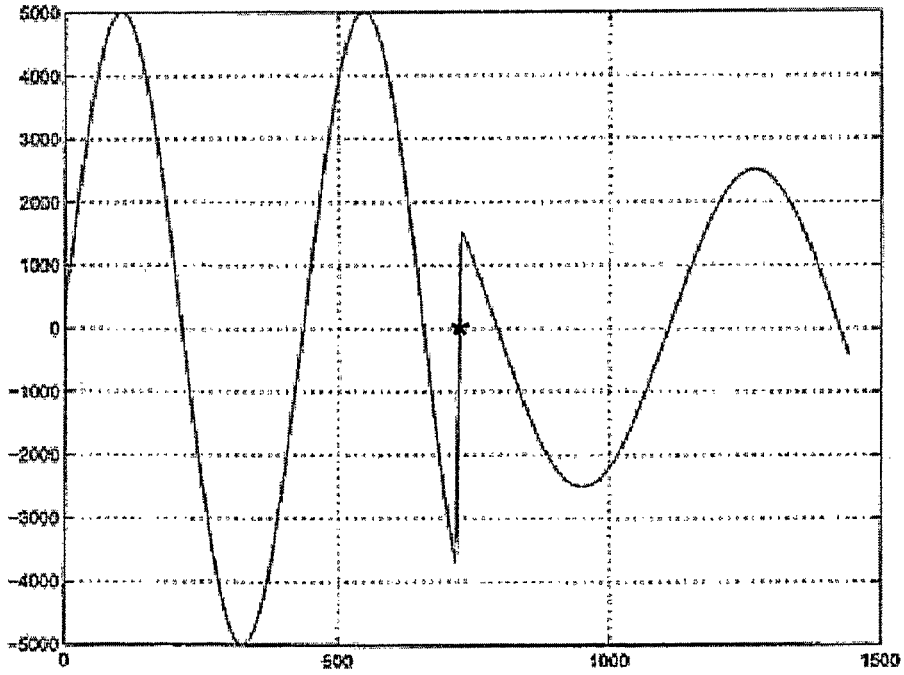

However, the above-described known method has certain drawbacks. In case of transients, the modified windowing for the synthesis of the sinusoids does preserve the temporal structure in transient regions, due to the reduced period of overlap. However, this can lead to audible artefacts for sinusoids with low frequencies. In FIG. 4, two sinusoids with low frequencies, 100 Hz and 70 Hz, are shown synthesised with a small period of overlap. At the transient position, a large discontinuity between the two sinusoids is present. This abrupt change has a high-frequency content, which is perceived as a click. If the period of overlap is extended, the discontinuity in the waveform will disappear, but the temporal structure around transients will also be lost, giving rise to pre-echoes. The invention solves this problem.

It has been observed that at higher frequencies a smaller period of overlap does not introduce audible artefacts in the waveform. This is due to the shorter period of the high frequency sinusoids. On the other hand, for sinusoids with low frequencies, a larger period of overlap is more tolerable than for sinusoids with high frequencies. In high frequency regions, the temporal structure is more important than for low frequency regions. Therefore, in accordance with the invention the size of the period of overlap around transients is made frequency dependent. For low frequencies, the period of overlap is larger in order to prevent clicks. A smaller period of overlap is chosen for the higher frequencies. At low frequencies the temporal resolution of the human ear is less than at high frequencies. Therefore, larger period of overlap between windows are allowed from a perceptual point of view.

The above object and features of the present invention will be more apparent from the following description of the preferred embodiments with reference to the drawings, wherein:

FIG. 1 shows a diagram illustrating an overlap-add procedure for synthesizing sinusoids using normal windowing, FIG. 2 shows a diagram illustrating an overlap-add procedure for synthesizing sinusoids using modified windowing, FIG. 3 shows traces of waveforms of synthesized sinusoids, FIG. 4 shows a trace of waveforms of two synthesized sinusoids with low frequencies.

In the Figures, identical parts are provided with the same reference signs.

The invention includes the above-described known method of modifying the period of overlap between windows of consecutive segments including a transient position, both in encoding and decoding. The method of the invention improves the known method by making the period of overlap between windows of consecutive segments dependent on the frequency of the sinusoid. In particular, the period of overlap is longer for low frequencies than for high frequencies.

In theory, the size of the period of overlap around transients can be calculated directly from the frequency of the sinusoids. For example, the frequency dependent overlap period O(f), measured in number of samples in the overlap period, can be defined as a decreasing function of the frequency f in Hz, e.g. as follows:

$$O(f) = \text{round}\left\{a - b \cdot \left\{\frac{f}{F_s/2}\right\}^{1/c}\right\} \tag{3}$$

where $F_s$ is the sampling frequency in Hz, e.g. 44.1 kHz, and a, b and c are constants that are experimentally determined to give good perceived sound quality, in particular avoiding pre-echoes at high frequencies and clicks at low frequencies. In a preferred embodiment, a=100, b=96 and c=7, which results in a slowly varying period of overlap per frequency. Different functions can be defined.

For every sinusoid, a new window has to be constructed in order to perform the overlap. This increases the computational complexity of the sinusoidal synthesis significantly at transient positions only.

A simplification of the method described above is to use a few discrete values instead of a continuous variation. In the simplest embodiment of the invention, for sinusoids with a frequency below 400 Hz the period of overlap is set to 100 samples, whereas for sinusoids with a frequency higher than 400 Hz, a period of overlap of 10 samples can be used. Then only two types of windows are needed. Naturally, any suitable number of frequency intervals and corresponding overlap periods can be chosen.

[1] E. G. P. Schuijers, A. C. den Brinker and A. W. J. Oomen. Parametric Coding for High-Quality Audio. Preprint 5554, 112th AES Convention, Munich, 10-13 May 2002.

The invention claimed is:

1. A method of synthesizing a signal comprising sinusoids from encoded data, the encoded data comprising, for each of a plurality of consecutive time segments, one or more frequency values (f) representing sinusoids, and data identifying times of occurrence of transients, the method comprising the steps of:

generating sinusoids with each of the one or more frequency values (f), and linking sinusoids across a plurality of consecutive segments;

identifying sinusoidal segments corresponding to segments in the encoded data containing transients using said data identifying times of occurrence of transients;

weighting sinusoidal segments, corresponding to encoded data segments with no transients, with a normal window (W1, W2, W3) having a normal leading edge and a normal trailing edge, and where consecutive sinusoidal segments have a normal period of overlap (O) of their trailing edges and leading edges, respectively; and weighting sinusoidal segments, corresponding to encoded data segments in which the time of occurrence of a transient is identified, with a first modified window (W1m) having a modified trailing edge, and weighting a following sinusoidal segment with a second modified window (W2m) having a modified leading edge, so that the modified trailing edge and the modified leading edge have a modified period of overlap (Om), which comprises the time of the occurrence of the transient, and which is shorter than the normal period of overlap (O), wherein the modified period of overlap (Om) depends on the frequency value (f).

2. The method as claimed in claim 1, wherein the modified period of overlap (Om) decreases with increasing frequency value (f).

3. The method as claimed in claim 1, wherein the modified period of overlap (Om) depends on the frequency value (f) substantially as f1/c.

4. The method as claimed in claim 1, wherein two or more fixed values of the modified period of overlap (Om) are used for corresponding frequency intervals.

5. The method as claimed in claim 1, wherein the modified period of overlap (Om) depends on the frequency value (f) substantially as $$O(f) = \text{round}\left\{a - b \cdot \left\{\frac{f}{F_s/2}\right\}^{1/c}\right\}.$$

6. The method as claimed in claim 1, wherein the modified period of overlap (Om) depends on the frequency value (f) providing a limited number of discrete steps of modified periods of overlap (Om).

7. The method as claimed in claim 6, wherein the modified period of overlap (Om) depends on the frequency value (f), whereas for sinusoids with a frequency below 400 Hz, a period of overlap is set to 100 samples, whereas for sinusoids with a frequency higher than 400 Hz, a period of overlap is set to 10 samples.

8. An audio decoder for synthesizing a signal comprising sinusoids from encoded data, the encoded data comprising, for each of a plurality of consecutive time segments, one or more frequency values (f) representing sinusoids, and data identifying times of occurrence of transients, the audio decoder being adapted to generate sinusoids with each of the one or more frequency values (f), and linking sinusoids across a plurality of consecutive segments, identify sinusoidal segments corresponding to segments in the encoded data containing transients using said data identifying times of occurrence of transients, weight sinusoidal segments, corresponding to encoded data segments with no transients, with a normal window (W1, W2, W3) having a normal leading edge and a normal trailing edge, and where consecutive sinusoidal segments have a normal period of overlap (O) of their trailing edges and leading edges, respectively, and weight sinusoidal segments, corresponding to encoded data segments in which the time of occurrence of a transient is identified, with a first modified window (W1m) having a modified trailing edge, and weight a following sinusoidal segment with a second modified window (W2m) having a modified leading edge, so that the modified trailing edge and the modified leading edge have a modified period of overlap (Om), which comprises the time of the occurrence of the transient, and which is shorter than the normal period of overlap (O), wherein the modified period of overlap (Om) depends on the frequency value (f).

9. The audio decoder as claimed in claim 8, wherein the modified period of overlap (Om) depends on the frequency value (f) substantially as $$O(f) = \text{round}\left\{a - b \cdot \left\{\frac{f}{F_s/2}\right\}^{1/c}\right\}.$$

10. The audio decoder as claimed in claim 8, wherein the modified period of overlap (Om) depends on the frequency value (f) providing a limited number of discrete steps of modified periods of overlap (Om).

11. The audio decoder as claimed in claim 10, wherein the modified period of overlap (Om) depends on the frequency value (f), whereas for sinusoids with a frequency below 400 Hz, a period of overlap is set to 100 samples, whereas for sinusoids with a frequency higher than 400 Hz, a period of overlap is set to 10 samples.

12. An audio encoder for encoding a signal comprising sinusoids from encoded data, the encoded data comprising, for each of a plurality of consecutive time segments, one or more frequency values (f) representing sinusoids, and data identifying times of occurrence of transients, wherein the audio encoder is adapted to generate sinusoids with each of the one or more frequency values (f), and linking sinusoids across a plurality of consecutive segments, identify sinusoidal segments corresponding to segments in the encoded data containing transients using said data identifying times of occurrence of transients, weight sinusoidal segments, corresponding to encoded data segments with no transients, with a normal window (W1, W2, W3) having a normal leading edge and a normal trailing edge, and where consecutive sinusoidal segments have a normal period of overlap (O) of their trailing edges and leading edges, respectively, and weight sinusoidal segments, corresponding to encoded data segments in which the time of occurrence of a transient is identified, with a first modified window (W1m) having a modified trailing edge, and weight a following sinusoidal segment with a second modified window (W2m) having a modified leading edge, so that the modified trailing edge and the modified leading edge have a modified period of overlap (Om), which comprises the time of the occurrence of the transient, and which is shorter than the normal period of overlap (O), wherein the modified period of overlap (Om) depends on the frequency value (f).

13. The audio encoder as claimed in claim 12, wherein the modified period of overlap (Om) depends on the frequency value (f) substantially as $$O(f) = \text{round}\left\{a - b \cdot \left\{\frac{f}{F_s/2}\right\}^{1/c}\right\}.$$

14. The audio encoder as claimed in claim 12, wherein the modified period of overlap (Om) depends on the frequency value (f) providing a limited number of discrete steps of modified periods of overlap (Om).

15. The audio encoder as claimed in claim 14, wherein the modified period of overlap (Om) depends on the frequency value (f), whereas for sinusoids with a frequency below 400 Hz, a period of overlap is set to 100 samples, whereas for sinusoids with a frequency higher than 400 Hz, a period of overlap is set to 10 samples.

* * * * *